United States Patent [19]

Furr et al.

[11] 4,025,073

[45] May 24, 1977

[54] TABLE SOCCER OR FOOTBALL GAME STRUCTURE

[76] Inventors: Robert L. Furr; Robert I. Hayes, Jr., both of 4215 Oak Lawn Ave., Dallas, Tex. 75219

[22] Filed: Nov. 5, 1975

[21] Appl. No.: 629,002

Related U.S. Application Data

[62] Division of Ser. No. 370,915, June 18, 1973, Pat. No. 3,926,432.

[52] U.S. Cl. ..... 273/85 D
[51] Int. Cl.[2] ..... A63F 7/06
[58] Field of Search ..... 273/3 R, 67 A, 85 R, 273/85 A–85 E, 108–126; 46/43

[56] References Cited

UNITED STATES PATENTS

| | | | |
|---|---|---|---|
| 682,807 | 9/1901 | Minor | 273/67 A |
| 1,544,411 | 6/1925 | Kern | 273/112 |

FOREIGN PATENTS OR APPLICATIONS

| | | | |
|---|---|---|---|
| 224,984 | 3/1943 | Switzerland | 273/85 C |
| 240,238 | 4/1946 | Switzerland | 273/85 D |
| 502,165 | 6/1939 | United Kingdom | 172/85 C |

*Primary Examiner*—Richard J. Apley
*Attorney, Agent, or Firm*—Crisman & Moore

[57] ABSTRACT

A generally improved rectangular fussball game table having raised side walls and end walls with goal openings and a pebbled glass playing surface for improved ball handling. The game table includes four vertical legs of rectangular cross-section having table leveling feet and a plurality of rod-mounted, balanced and weighted playing figures each having the foot thereof configured for improved ball handling characteristics.

9 Claims, 14 Drawing Figures

TABLE SOCCER OR FOOTBALL GAME STRUCTURE

This is a division of application Ser. No. 370,915, filed June 18, 1973, now U.S. Pat. No. 3,926,432.

BACKGROUND OF THE INVENTION

1. Field of the Invention

This invention relates to fussball game tables, and more particularly, to an improved fussball game table including a pebbled glass playing surface and improved playing figures.

2. History of the Prior Art

This invention is directed to a fussball (also known as table soccer) game table generally of the type shown in U.S. Design patent application Ser. No. 255,930 filed May 22, 1972 by Robert L. Furr and Robert I. Hayes, Jr. Prior art fussball games typically include a rectangular, box-like playing area supported on four angularly mounted and reinforced legs. A plurality of axially slideable actuating rods are mounted extending transversely of the playing area. The actuating rods mount a plurality of playing figures which are arranged above the playing surface of the table in a preselected formation. A light ball is placed on the playing surface and propelled by sharply rotating the actuating rods so that a foot of the figures strikes the ball and propels it along the playing surface toward one of the two goals located in opposite end walls. Prior art playing surfaces have generally been formed of a hard, smooth glossy material imprinted with a soccer field pattern or of rippled or hammered, wired glass having relatively large dimpled indentations located on rectangular grids forming raised adjacent lenses.

Prior art fussball game tables have included a number of disadvantageous features. For example, angularly mounted and cross-braced legs are relatively unstable and, generally, may not be adjusted to the level the game table; smooth, glossy playing surfaces may lead to errors in ball trajectory; and unbalanced, molded playing figures tend to return to an upright, vertically oriented position when the actuating rod is released and may thereby obstruct one's own pathway toward the desired goal. Each of these structual characteristics, along with other disadvantageous features, of conventional, prior art table soccer games has been overcome by the improved table soccer game of the invention.

SUMMARY OF THE INVENTION

The invntion relates to a table soccer game, and more particularly, to apparatus for such a game that improves the ball handling and other playing characteristics of the game to increase the speed and precision with which the game is capable of being played.

BRIEF DESCRIPTION OF THE DRAWINGS

For a more complete understanding of the present invention and for further objects and advantages thereof, reference may now be had to the folliwing description taken in conjunction with the accompanying drawing, in which.

DETAILED DESCRIPTION

Figure 1A:
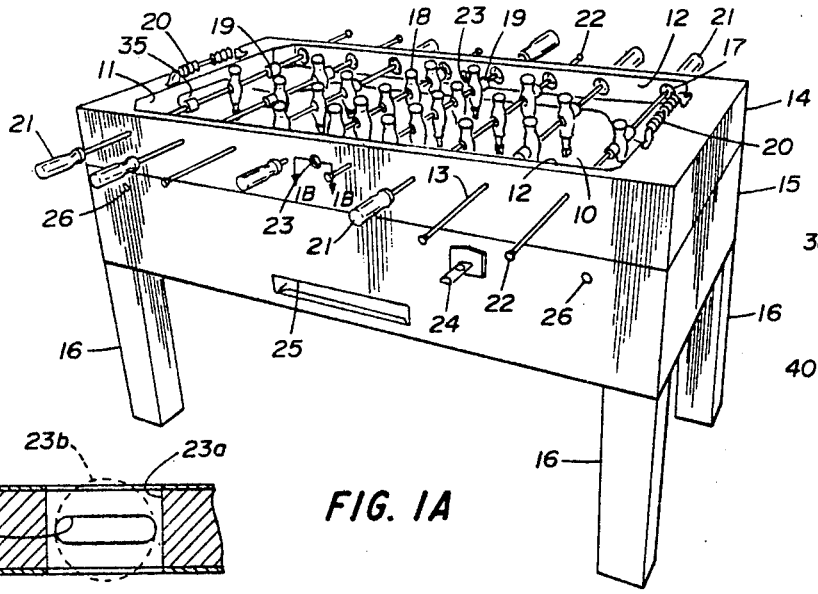
FIG. 1A is a prespective view of a fussball game table constructed in accordance with the invention.

Referring to FIG. 1A of the drawing, the game table of the present invention includes a playing surface 10, vertically extending end and sidewalls 11 and 12, respectively, and a plurality of transversely disposed playing figure actuating rods 13 rotateably mounted and axially slideable in opposite sidewalls 12. The playing surface 10 and the vertically extending end and sidewalls 11 and 12 comprise a top housing unit 14. The top unit 14 is hinged along the back edge to a lower housing unit 15 which is supported upon four vertically extending, rectangular legs 16.

The actuating rods 13 are rotatably and slideably supported in a plurality of pairs of bearings 17 which are spaced along and in axial alignment with clearance apertures passing through the opposed longitudinal sidewalls 12. Each actuating rod 13 rigidly mounts one or more game figures 18. Soft, shock absorbing rubber bushings 10 are mounted to the actuating rods 13 and located outside the outermost game figures 18. The rubber bushings 19 function as bumpers to prevent the game figures 18 from striking too hard against the inner sides of the walls 12, even during vigorous playing as the actuating rods 13 are quickly shifted laterally in the bearings 17 to move the figures carried thereby relative to the playing surface 10. Each one of the actuating rods 13 is fixed to a handle 21 at the playing end terminated by a cap 22 at the opposite end. The advantageous configuration of the handles 21 will be explained in greater detail below in connection with FIGS. 8A and 8B. The upper housing 14 includes ball drop openings 23 passing through opposite side walls near the center of the playing surface 10 and score keepers 20 located on the tops of opposite ends.

Figure 1B:
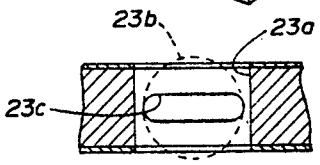
FIG. 1B is a cutaway cross-section view of a ball drop opening taken about lines 1B — 1B of FIGURE 1A.

The ball drop opening 23 is best shown in the cross-section view of FIG. 1B and comprises a circular hole **23*a*, greater in diameter of the ball 23*b* to be used. In the bottom center of each hole 23*a*** is located a groove 23c, formed with a router to hold the ball within the hole until play begins. Prior art ball drops generally include an exterior cup-like member into which the ball is deposited so that it rolls out the hole onto the playing surface. The ball drop of the present invention 23 eliminated the cup member, thereby providing a smoother appearance to the table, and enabling the player dropping the ball to simultaneously spin it and thereby bias the ball in his favor.

The score keepers 20 each comprise a pair of upstanding posts having a horizontal rod extending therebetween. The rod mounts and supports a plurality of circular score discs which may be moved easily along the rod and which make a loud and psychologically pleasing "clicking" noise when moved against the other discs.

Figure 2:
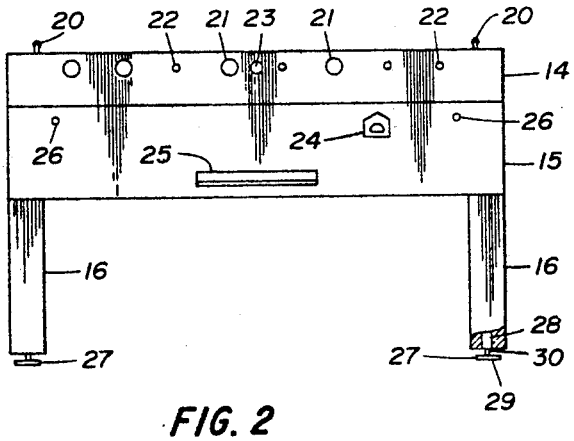
FIG. 2 is a front elevational view of the fussball game table depicted in FIG. 1A.

Referring now to FIG. 2 of the drawing, the lower housing unit 15 includes in the front surface thereof, a coin receiving and actuating mechanism 24 and a ball dispensing opening 25. The upper and lower portions 14 and 15 are hinged along the back side and are held together by a pair of keyactuated locks 26 located at opposite ends of the front side of the table. Each of the table legs 16 is supported by a threadedly adjustable leveling foot 27. The adjustable foot 27 includes an elongate hex nut 28 driven into a tightly fitting hole in the bottom of each leg 16. A circular plate 29 is attached to a bolt 30 which threadedly engages the nut 28. The playing surface 10 may be accurately leveled by placing a carpenter's level (not shown) in the center of the playing area and rotating appropriate ones of the leveling feet 27.

Figure 3:
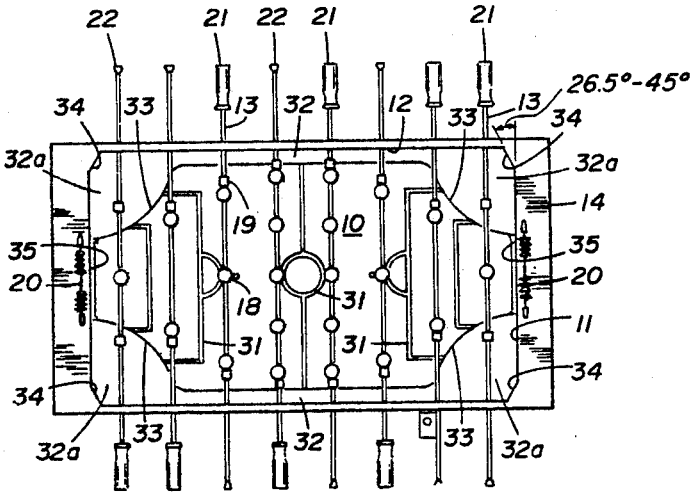
FIG. 3 is a top plan view of the fussball game table depicted in FIG. 1A.

Referring next to FIG. 3 of the drawing, there is shown a top view of the fussball game table constructed in accordance with the invention. The actual playing surface 10 overlies a printed soccer field configuration 31 which is supported by a solid undersurface. The outside edges of the playing area are lined by an inclined border 32 which extends from the walls 11 and 12 out onto the playing area and makes a small angle, approximately 6°, with the horizontal playing surface. The inclined border 32 surrounds the entire playing area except for the two goal openings 35 located in the center of opposite end walls 11. Each of the corner pieces 32a of the border 32 is formed with a curved front edge 33 which helps in preventing the playing balls (not shown) from being stuck in a "dead spot"; i.e., a location where the ball cannot be moved by a playing figure 18. The small incline made by the border 32 with the playing surface 10 assists in returning the ball from the difficult to reach side portions of the playing area.

Each of the four corners of the playing area, bounded by an end wall 11 and a side wall 12, is formed by a flat, angularly positioned corner section 34. The surface of each corner section 34 makes an angle of approximately 30° with the end walls 11. In one embodiment of the invention, a corner section making an angle of 26.5° proved highly satisfactory. The corner section 34 is preferably positioned at a relatively small angle (less than 45°) with respect to the end wall so that when it is struck by a ball moving from the direction of the opposite end, the ball will rebound more back toward the opposite end of the playing field rather than toward the opposite side of the field. Corner pieces positioned at an angle of 45° or greater increases the chances of a ball bouncing off the corner into the goal opening thus producing an accidental and undeserved goal. As with other game table corner pieces, the section 34 serves to return the ball to the playing surface with a minimum of delay and interruption of the game.

Figure 4B:
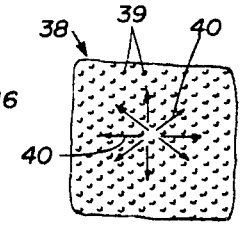
FIG. 4B is a cutaway, diagramatic top view of the pebbled glass playing surface.
Figure 4A:
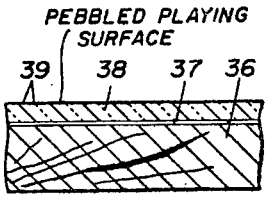
FIG. 4A is a typical cutaway cross-sectional view of the bottom of the game table of the present invention, illustrating the pebbled glass material which forms the playing surface thereof.

Referring now to FIG. 4A and FIG. 4B, there are shown, respectively, a typical cutaway cross-section view of the bottom of the table with borders removed and a cutaway diagramatic top view of the upper surface of the playing area 10. In FIG. 4A, it can be seen how a wooden underlayer 36 supports a paper sheet 37 having a soccer field configuration printed thereon. The sheet 37 is covered by a layer of glass 38 having a pebbled upper surface 39. The glass 38 preferably of a type of figured, rolled glass such as that sold under the brand name of "Industrex" by ASG Industries of Kingsport, Tennessee. A similar suitable figured, rolled glass is that sold under the brand name of "Factrolite" by CE Glass Company of St. Louis, Missouri. The upper surface of the glass, also shown in FIG. 4B, is comprised of a plurality of rounded pebbles 39 arranged on the surface of the glass in a selected pattern. The pattern is preferably formed so that there are a number of linear paths (the directions of which are illustrated by arrows 40) formed in the valleys between the pebbles 39. The inclusion of a pebbled glass playing surface results in a fussball table with greatly improved playing characteristics. For example, during relatively slow movement of the ball (i.e., passing the ball between playing figures), the pebbles increase the accuracy and linearity of movement of the ball due to the linear paths created in the valleys between the pebbles 39. The pebbled glass surface also increases the speed of the game by decreasing the friction of the ball on the surface, since a rapidly moving ball will only touch the tops of the pebbles. Finally, when a ball is propelled rapidly across the pebbled glass playing surface, it produces a "zipping" noise which has proven to be psychologically satisfying to players.

Figure 5:
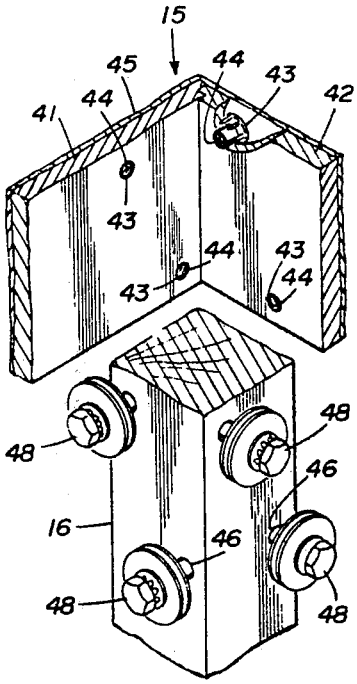
FIG. 5 shows an exploded view of one of the vertical table legs illustrating the manner of attachment to the table of the invention.

To assure maximum stability and rigidity the legs 16 are attached to the lower portion of the table 15 as shown in FIG. 5. The two members 41 and 42 forming a corner of the lower portion are drilled through with holes 43 and a "T-nut" 44 is hammered from the outside surfce into each hole. A layer of outer finishing material 45, such as a laminated plastic sheet, for example, "Formica", is installed to cover the outer portion of the holes and the T-nuts. Each leg 16 is drilled with holes 46 to mate with the holes 43 in the corner members. A bolt 48 is passed through each of the holes 46 to engage the internally threaded portion of the T-nuts 44 within the holes 43. By tightening the bolts 48, each leg 16 is held in position in an extremely sturdy but yet easily removable configuration without the use of cross braces. Removability of the legs is particularly important in fussball game tables which must periodically be moved through doorways and other obstructions into the area of use.

Figure 6A:
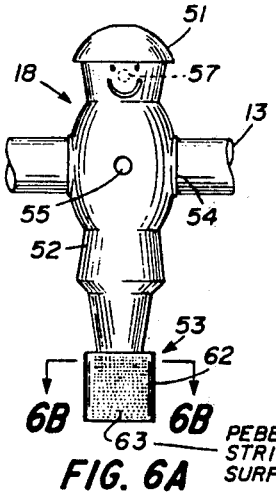
FIG. 6A is a front elevational view of a playing figure constructed in accordance with the invention.
Figure 7:
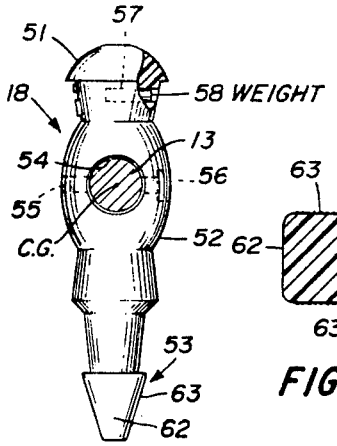
FIG. 7 is a side elevational view of the playing figure shown in FIG. 6A.
Figure 6B:
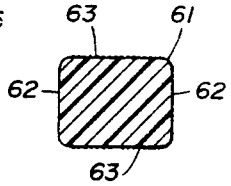
FIG. 6B is a cross sectional view taken about the lines 6B — 6B of FIG. 6A.

Referring now to FIGS. 6A, 6B and 7, there are shown, respectively, front and side views of a balanced playing figure 18 constructed in accordance with the invention. As shown in FIG. 6A, the playing figure 18 comprises a head portion 51, a body portion 52 and a foot portion 53. The body portion 52 is perforated by a transverse opening 54 for receiving an actuating rod 13. A lateral opening 55 is formed in the body portion to receive a bolt (not shown) which passes through aligned apertures in the rod 13 and is secured by a nut (not shown) held in position by a hexagonal socket 56. The bolt passing through the opening 55 secures the playing figure to the actuating rod 13 passing through the opening 54.

The head portion 51 of the playing figure 18 includes a recess 57 for receiving a weight 58, shown in FIG. 7 by cutting away part of the head portion 51. The weight 58 may be either molded into the playing figure or may be added through an external opening into the recess 57. The mass of the weight 58 and the exact position of the recess 57 are chosen to balance the playing figures on the actuating rod 13 so that if the actuating rod is turned to position the longitudinal axis of the playing figure in a horizontal plane, the playing figure will remain in place rather than returning to its usual upright or vertical position.

The use of weighted and balanced playing figures on the actuating rods is particularly helpful in the playing of singles games so that ones own playing figures may be removed as an obstruction to the flight of the ball by turning them to a horizontal position where they will remain after release. In fussball game tables having unbalanced playing figures, one must continually hold the actuating rods so that the playing figures remain in a horizontal position. When the rods with unbalanced figures are released, they return to their upright position and can unintentionally block or deflect ones own ball proceeding in a trajectory toward a goal opening.

The foot portion 53 of the playing figure 18 is of large significance in the effectiveness and accuracy of the playing figure. As illustrated in the cross-section view of FIG. 6B taken about the lines 6B—6B of FIG. 6A, a small smooth radius 61 is placed at each of the four corners of the foot 53 to permit control over the ball while making "bank" or "angle" shots. The sides of the foot 62 are smooth and flat to permit control in lateral passing of the ball from one playing figure to the next. The front and rear surfaces 63 of the foot 53 are flat and pebbled for increased friction and the angle of the surfaces 63 with the horizontal (shown best in FIG. 7) permits the playing figure to propel the ball at very high velocity without "lofting" the ball or allowing it to leave the playing surface.

Figure 8B:
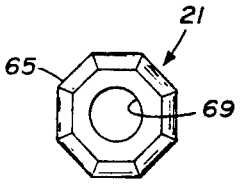
FIG. 8B is an end plan view of the handle shown in FIG. 8A.
Figure 8A:
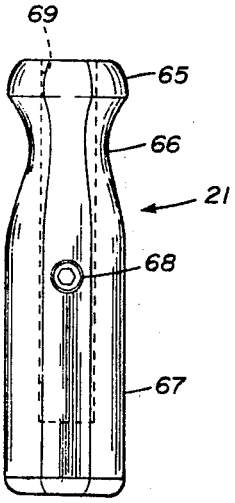
FIG. 8A is a bottom view of a playing figure actuating rod handle constructed in accordance with the invention.

An actuating rod handle 21, constructed in accordance with the invention, is shown in FIG. 8A and 8B. The proper configuration of handle is quite important in that a player's only physical contact with the table is made through the handle. The improved handle 21 shown in FIGS. 8A and 8B is generally octagonal in shape and includes a flange 65 at the front of the handle which prevents a player's hand from slipping forward and off the handle when an actuating rod (not shown) is pushed forward with great force. A waist portion 66 allows the handle to be gripped comfortably and properly while a back portion 67 provides for optimum grip. A counter-sunk hole is formed in the handle to receive a "socket head cap" screw 68 which is recessed and provides minimum obstruction to the player's grip on the handle. The central circular opening 69 is formed in the handle to receive an actuating rod 13, as shown in FIG. 3. An end view of the octagonal handle is shown in FIG. 8B.

Figure 9:
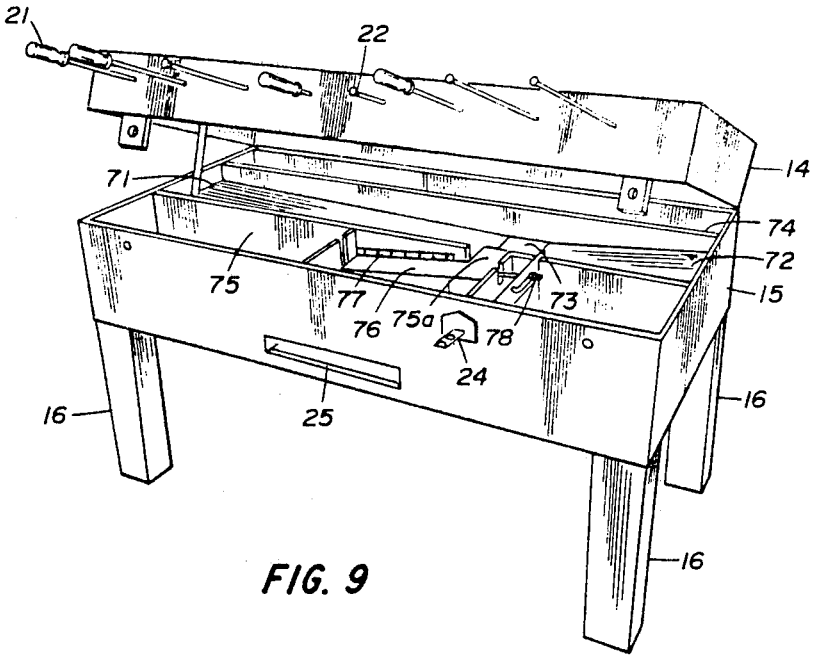
FIG. 9 is a top perspective view of the table shown in FIG. 1A with the top portion of the table tilted upwardly to expose the playing ball collecting and dispensing structure therein.
Figure 10:
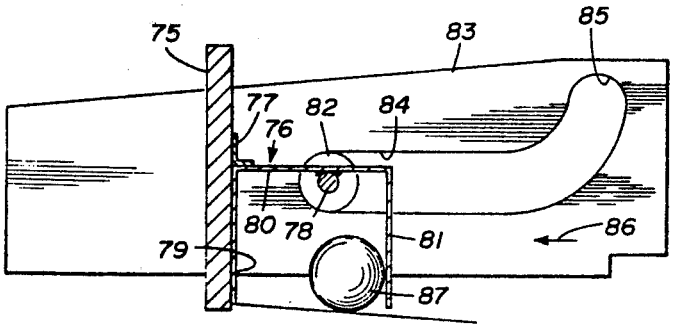
FIG. 10 is a side view of a ball trap and ejecting mechanism constructed in accordance with the invention.

Referring next to FIG. 9, there is shown a view of the fussball game table of the present invention with the top portion of the table 14 pivoted up about its hinges to expose the internal mechanisms in the bottom portion 15. At opposite ends of the table, beneath the goal openings, there are located inclined collection ramps 71 and 72 which both converge on an inclined feeding ramp 73. Each of the ramps 71, 72 and 73 are located between vertically extending side boards 74 and 75. Balls traveling down either of the ramps 71 or 72 and onto the ramp 73 are directed through an opening in the sidewall 75 into an opening 75*a* in a ball trap mechanism 76. The ball trap 76 is hinged along the back edge 77 and attached to an operating shaft 78 at one end. As best shown in FIG. 10, the ball trap mechanism 76 is channel shaped and includes a back wall 79, a top plate 80 and a front wall 81. The operating shaft 78 is fixed to the inside of the top plate 80 and terminated by a roller 82 which is received within an operating plate 83. The operating plate 83 is attached at its rightmost end to the coin receiving and actuating mechanism 24 (FIG. 9). The plate 83 includes a slot having a straight portion 84 and an upwardly curved portion 85. When a coin is deposited and the actuating mechanism 24 (FIG. 9) pressed inwardly, the operating plate 83 is moved in the direction of the arrow 86 to move the operating rod 78 upwardly and pivot the channel member 76 about its rear edge 77 which swings the rear wall 79 of a channel member in a counter clockwise direction and "ejects" the balls 87 out into the ball dispensing opening 25 (FIG. 9). The ball trap and ejecting mechanism of the present invention is an improvement over prior art ball traps in that regardless of whether gum papers, cigarette packs, or other small foreign objects may have become lodged down in the mechanism, they do not prevent the balls from moving into the dispensing opening 25.

As can be seen from the above description, the fussball game table of the present invention includes numerous features which are advantageous over those of the prior art. Among other features, the pebbled glass playing surface; the sturdily mounted, adjustable leveling legs; the properly angled corners; the balanced playing figure with a uniquely configured foot; the configured actuating rod handles; and the ejecting ball trap mechanism each contribute to produce a fussball game table with vastly superior overall playing characteristics.

Having described the invention in connection with certain specific embodiments thereof, it is to be understood that further modifications may now suggest themselves to those skilled in the art and it is intended to cover such modifications as fall within the scope of the appended claims.

What is claimed is:

1. A table soccer or football game structure comprising:

a top housing unit having a playing field portion surrounded by raise opposite side walls and end walls, said end walls each having a goal opening therein, a plurality of actuating rods extending through said opposite side walls spaced transversely and above said playing field portion and supporting game figures thereon depending adjacent said playing field portion and adapted to contact a ball thereon, said actuating rods being rotatively and axially movable relative to said side walls; and a ball drop opening extending through said side wall, said opening having a groove formed in the lower central portion for supporting a ball in a stationary position for being spun through the hole and onto the playing surface with a select motion bias to start the game.

2. A table soccer or football game structure as set forth in claim 1 wherein said ball drop opening is a circular aperture formed with cylindrical sidewalls aligned in generally parallel spaced relationship with said actuating rods of said top housing unit.

3. A table soccer or football game structure as set forth in claim 2 wherein said groove of said ball drop opening comprises an elongated slot formed in the lower central portion of said sidewalls of the said ball drop opening and generally perpendicular to adjacent portions of said cylindrical sidewalls thereof.

4. A table soccer or football game structure as set forth in claim 3 wherein said elongated slot is generally centrally positioned between the opposing ends of said ball drop opening for retaining a ball positioned therein in a generally centrally aligned configuration.

5. A table soccer or football game structure comprising:

a top housing unit having a playing field portion surrounded by raised opposite sidewalls and endwalls, said endwalls each having a goal opening therein, a plurality of actuating rods extending through said opposite sidewalls spaced transversely and above said playing field portion and supporting game figures thereon depending adjacent said playing field portion and adapted to contact a ball thereon, said actuating rods being rotatively and axially movable relative to said sidewalls;

a generally cylindrical ball drop opening extending transversely through at least one of said sidewalls above said playing field surface; and means for both retaining a playing ball in a stationary position within said opening prior to commencement of play and providing an edge between the ball and the playing surface against which the ball may be pressed immediately prior to discharging the ball onto the playing surface with a rotary motion having been imparted thereto.

6. A table soccer or football game structure as set forth in claim 5 wherein said retaining and edge providing means comprises a groove formed in the lower central portion of said ball drop opening.

7. A table soccer or football game structure as set forth in claim 6 wherein said groove is generally semicircular in cross section and is positioned in the lower central portion of the ball drop opening.

8. A table soccer of football game structure comprising:

a top housing unit having a playing field portion surrounded by raised opposite sidewalls and endwalls each having a goal opening therein, a plurality of actuating rods extending through said opposite sidewalls spaced transversely and above said playing field portion and supporting game figures thereon depending adjacent said playing field portion and adapted to contact a ball thereon, said actuating rods being rotatively and axially movable relative to said sidewalls;

a generally cylindrical ball drop opening extending transversely through at least one of said sidewalls above said playing field surface; and a depression formed within the lower portion of said opening for retaining a ball in said opening prior to service and for enabling a player to impart a spring to the ball during service and thereby biasing the ball in the serving player's favor.

9. A table soccer or football game structure as set forth in claim 8 wherein said depression comprises an elongate groove extending around the lower central portion of said opening.

* * * * *